United States Patent [19]

Harigai

[11] 4,197,448

[45] Apr. 8, 1980

[54] HAND-HELD HAIR DRYER

[75] Inventor: Hiroshi Harigai, Tokyo, Japan

[73] Assignee: Yamada Electric Industries, Co. Ltd., Matsudo, Japan

[21] Appl. No.: 767,668

[22] Filed: Feb. 11, 1977

[51] Int. Cl.[2] ..... A45D 20/10

[52] U.S. Cl. ..... 219/370; 219/367; 219/375; 34/97; 132/9; 34/243 R

[58] Field of Search ..... 219/364, 366–370, 219/373–377, 380–382; 132/9, 11 R, 32; 34/96–98, 243 R

[56] References Cited

U.S. PATENT DOCUMENTS

| | | | |
|---|---|---|---|
| 247,683 | 4/1978 | Rakocy et al. | D28/13 |
| 1,224,306 | 5/1917 | Lemp et al. | 219/364 |
| 1,659,780 | 2/1928 | Meyer | 219/366 |
| 2,017,929 | 10/1935 | Wahl | 219/370 |
| 3,086,698 | 4/1963 | Goldstein | 219/373 |
| 3,492,462 | 1/1970 | Schumacher | 219/370 |
| 3,846,047 | 11/1974 | Wada et al. | 219/373 |
| 3,981,314 | 9/1976 | Barradas | 34/97 |
| 3,986,272 | 10/1976 | Feirabent | 219/366 |
| 4,039,774 | 8/1977 | Kata et al. | 219/368 |
| 4,066,865 | 1/1978 | Godel et al. | 219/370 |

FOREIGN PATENT DOCUMENTS

| | | | |
|---|---|---|---|
| 480174 | 7/1929 | Fed. Rep. of Germany | 34/97 |
| 2528478 | 1/1977 | Fed. Rep. of Germany | 219/370 |
| 22626 | 1/1962 | German Democratic Rep. | 219/371 |
| 341957 | 12/1959 | Switzerland | 219/364 |
| 421405 | 9/1966 | Switzerland | 34/243 R |

*Primary Examiner*—Bruce A. Reynolds
*Assistant Examiner*—Bernard Roskoski
*Attorney, Agent, or Firm*—J. David Dainow

[57] ABSTRACT

An electric hair dryer having a generally spherical outer housing with an elongated handle extending in one direction, a generally spherical inner housing with an air discharge duct, the inner housing mounted in the outer housing in a first position with the duct extending in a direction opposite the handle, the inner housing being pivotable to a second position where the duct extends transversely of the handle, and a power section mounted within and pivotable with the inner housing and including an electric motor, a fan driven by the motor, and a cylindrical electric heater positioned such that air flows inwardly through its cylinder walls and then axially through the cylinder to the discharge duct.

14 Claims, 7 Drawing Figures

HAND-HELD HAIR DRYER

BACKGROUND OF THE INVENTION

This invention is in the field of electric hair dryers and blowers, and particularly portable hand-held type hair dryers wherein a light-weight housing contains an electric motor, a fan or blower, and a heating element.

In the field of hand-held hair dryers three common types include the pistol grip, styler-dryer, and axial flow. The pistol grip dryer has a pistol type handle, typically a centrifugal fan, and an air discharge tube generally at a right angle relative to the handle; the styler-dryer or vane-axial type has a blower shaped generally as a cylinder or squirrel cage comprising vanes positioned parallel to the axis of rotation, an adjacent discharge duct having length and width about the same as that of the blower, and a handle also parallel to the blower axis; and the axial-flow has a generally straight tubular shape, wherein one end serves as a handle, the opposite end serves as a discharge duct, a fan is situated in the tube near its mid-point for forcing air, entering at side vents to flow through the tube to exit its discharge end.

In each of these devices it was sought to provide certain advantages or novelty, and each has specific structure for such purpose. The pistol grip, for example, is the type frequently used by professional hair stylists, and has a gun barrel type discharge duct for providing an accurately directed and powerful air flow as the stylist points the duct at the customer's hair. The styler-dryer type is especially convenient for a user to dry her or his own hair, because the handle and blower portions comprise a single oblong construction; accordingly the handle may be held in a natural and comfortable, generally vertical position, while the air discharge portion is oriented to direct air at a right angle relative to the handle; the rather large cross-sectional area of the discharge duct will produce a similar broad air flow for effective drying without requiring accurate direction of the air to a precise location.

In the axial or through-flow type of dryer, the brush attachment has a central core which extends coaxially with the tube's handle and discharge duct, but has transversely extending bristles. The heated air from the blower flows axially through the attachment core and transversely out discharge apertures adjacent to the bristles. With this construction it is feasible to rotate the dryer such that hair will curl around the brush and hot air will then flow radially outward through the curls.

In each of the above-described types of hair dryers, there is a specific structure designed for a certain purpose, and consequently limited to such purpose. Furthermore, these dryers comprise an essentially fixed construction, wherein a rigid housing has a motor, blower, and heater in predetermined locations, with no possibility of moving or altering them, and not even a remote suggestion that such was contemplated. More particularly, in each of these devices the heater is mounted in or near a discharge portion of the housing, and the motor and fan are mounted in an adjacent portion of the housing with the result that housing, components, and air flow have a predetermined and fixed relationship.

The subject matter of the present invention is a new hairdryer, with a structural concept totally different from the above-described, typical prior art devices. The objective here is to provide flexibility and choice of function or method of drying, by providing a changable or variable structure. More specifically, this invention is first, a piston grip hair dryer, which may be modified to be an axial-flow type, and then to a styler-dryer type. A summary of the invention follows, and then a description of the drawings illustrating the preferred embodiment of this invention.

SUMMARY OF THE INVENTION

The new hair dryer invention is a structure which can be modified by the user to operate in different ways. As opposed to merely providing a pivotable discharge duct to vary the direction of the air flow, this invention locates the whole power section, including the motor, blower, heater, and discharge duct, in a sub-housing or inner housing, all of which is pivotable between at least first and second orientations 90 degrees apart, within a similar, generally spherical outer housing. The walls of the inner housing are generally spherical with opposite ends through which a central axis extends, open for intake and discharge air flows, and opposite sides including a pivot axis transverse of the central axis, whereby the inner housing is pivotable between its two positions. Mounted within the inner housing is a motor and connected fan; downstream of the fan is a cylindrical heater coaxial with the fan axis of rotation; also downstream of the fan the spherical housing converges for directing air flow from the fan inward through the walls of the heater, and then axially through the center of the heater to the brush attachment.

The generally spherical outer housing has a handle at one end, and at the opposite end has a slotted opening which extends 90° around to the bottom; it is through this slot that the exhaust duct extends when the inner housing-power unit pivots between its positions. The rear portion of the outer housing has apertures to allow sufficient intake air flow to the fan regardless of the orientation of the power section within said outer housing.

In the invention as described the power section or inner housing sub-assembly is separate from, and pivotable between, two points within the outer housing, and the handle extends fixedly from said outer housing. In another embodiment of this invention, portions of the outer housing-handle component are deleted until there remains at the end of the handle, a yoke for the two pivot points; between these two points the inner housing pivots, however in this case the inner housing has a rear wall perforated with air ducts instead of being open and encased by the outer housing.

In one of the preferred configurations of this new hair-dryer invention, there is a generally spherical center part defining the outer housing and inner housing, with a central axis therethrough, a handle extending rearward along said axis, and an exhaust duct extending forward along said axis. Any one of the three described, or other, attachments may be secured to the discharge end of the exhaust duct, which is of course pivotable to its 90° turned position. Where the handle and attachment have similar diameters and are coaxial, the invention could appear generally as a straight tube traversing a sphere.

There are many possible configurations and variations within the scope and claims of this invention, of which the preferred embodiment has been illustrated in the drawings attached hereto, and will now be described in detail.

DETAILED DESCRIPTION OF THE PREFERRED EMBODIMENT

Figure 1:
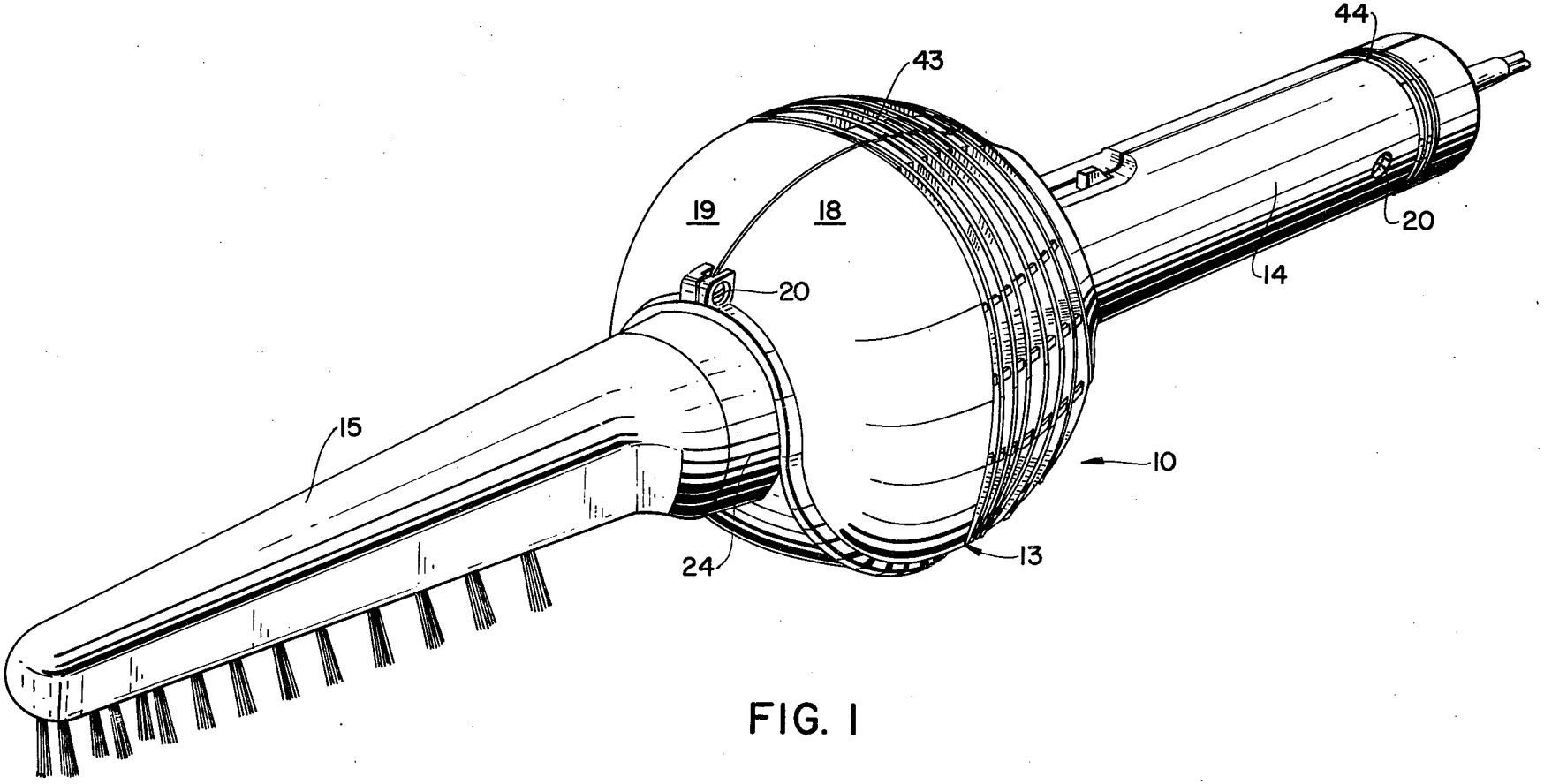
FIG. 1 is a perspective view of the new hair dryer, with a styler-dryer brush attachment.
Figure 2:
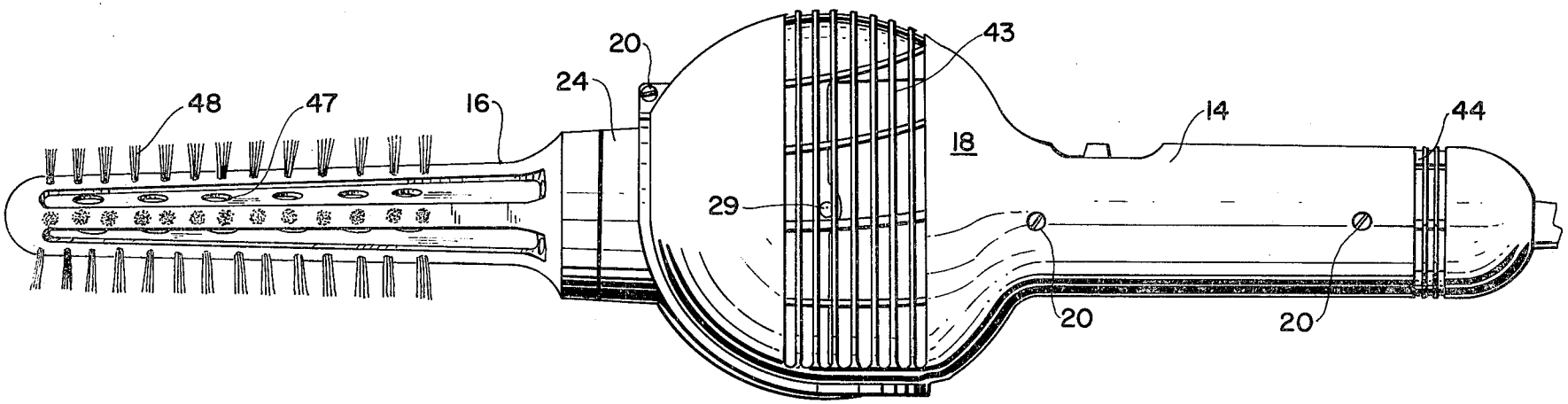
FIG. 2 is a side elevation of the new dryer, with axial flow brush attachment.
Figure 3:
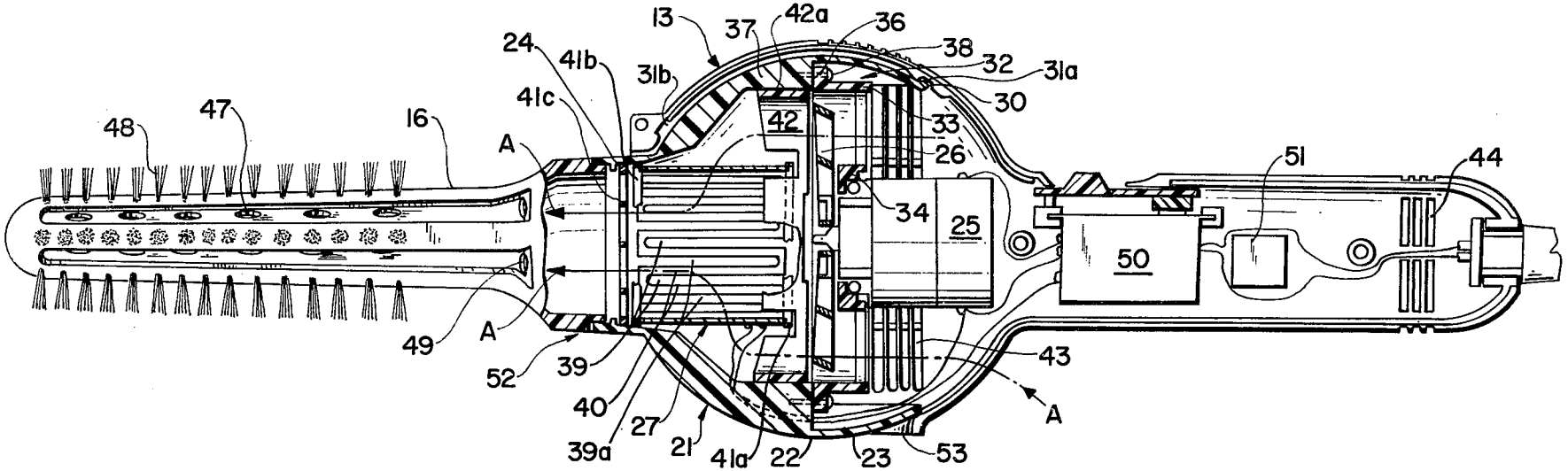
FIG. 3 is a side sectional view of the dryer shown in FIG. 2.
Figure 4:
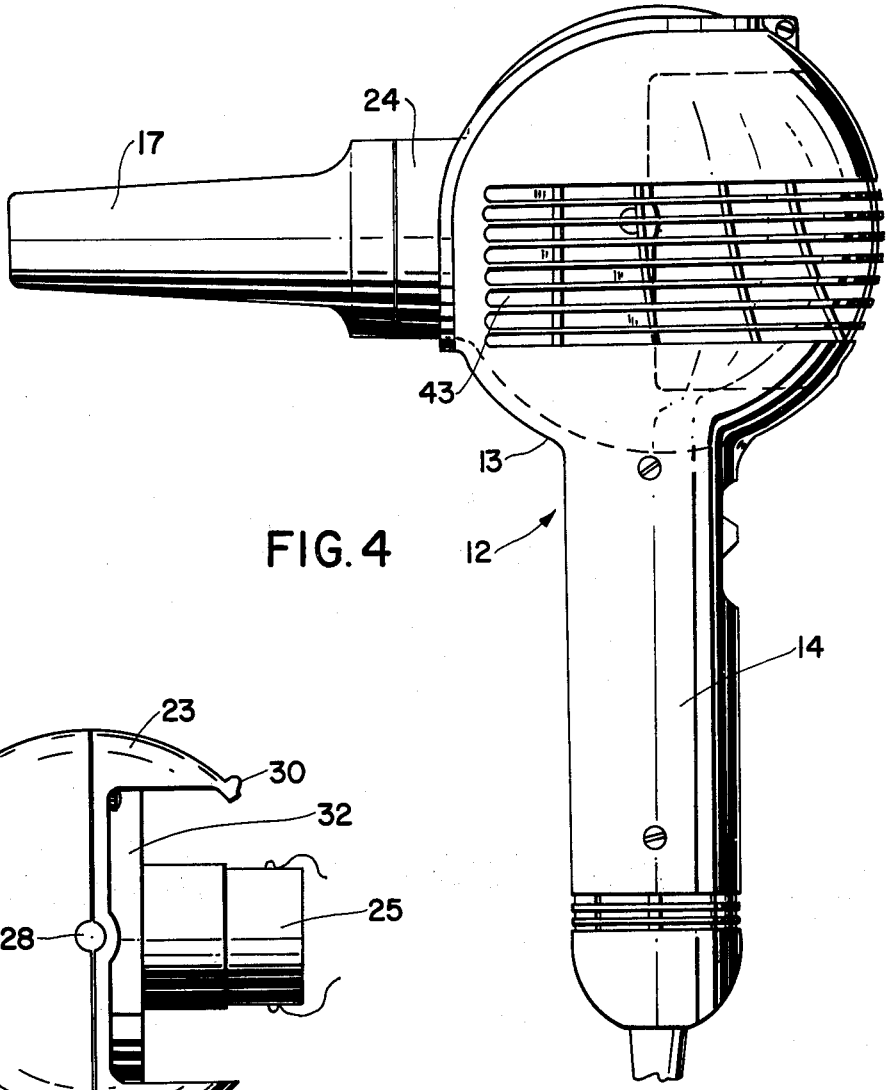
FIG. 4 is a side elevation showing the new dryer in a pistol-grip type configuration.

The new hair dryer is shown in three configurations of the many possibilities, namely the styler-dryer type 10 in FIG. 1, the axial-flow type 11 in FIG. 2, and the pistol grip type 12 in FIG. 4. The basic structure in each is a central outer housing 13, a handle 14, and a brush or exhaust attachment 15 in FIG. 1, 16 in FIG. 2 and 17 in FIG. 4. The outer housing and handle are formed of two mating shells 18 and 19, which may conveniently be secured together by bolts 20 or other fastening means. Within the central housing is the power or blower heater section 21 shown alone in FIG. 5 and within the outer housing 13 in FIGS. 3 and 6.

Figure 6:
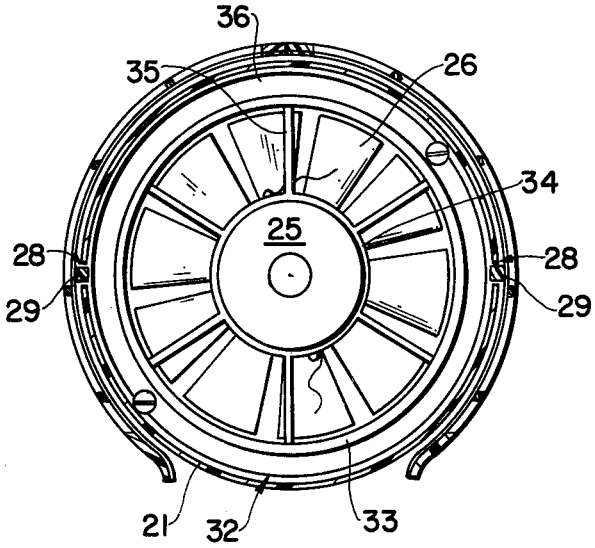
FIG. 6 is a sectional view taken along line 6—6 of FIG. 2.

The inner housing is a generally spherical shell 13 comprising front and rear sections 22, 23, air discharge port 24, motor, fan, and heater components 25, 26, and 27, and pivot apertures 28, into which fit pivot pins 29 extending inward from the outer housing, as specifically shown in FIG. 6. Thus the power section 21 includes the essential components for producing a flow of heated air, and this whole section is pivotable from a straight-through, axial-flow orientation of FIGS. 2 and 3 to a pivoted, right-angle orientation of FIG. 4.

Figure 5:
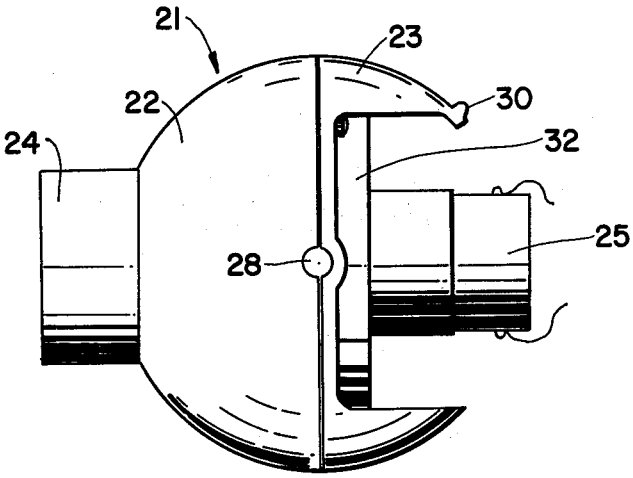
FIG. 5 is a side elevation of the movable power section of the new dryer.

The spherical inner shell 13 fits snugly within the outer housing 13, but nevertheless pivots smoothly. FIGS. 3 and 5 show a projection 30 at the edge of the rear section 23 of the inner shell; FIG. 3 shows a first detent 31*a* into which projection 30 resiliently fits when the power section is pivoted to straight-through position, and a second detent 31*b* into which projection 30 fits when the power section is pivoted to the second position shown in FIG. 4. The resilient flexibility of rear section 23 carrying projection 30, provides the spring force for urging this projection into either of the detents 31*a* or 31*b*, whereby the position of the power section is securely maintained until the operator of this device urges the power section to pivot and overcome the resistance.

Next will be described the internal struction and operation of the power section which is essentially self-contained within the spherical, inner shell 13. As seen in parts of FIGS. 3, 5, and 6, the electric motor 25 is secured to a mounting frame 32 which has outer ring 33, inner ring 34, connecting spokes 35, and flange 36. The motor is situated partly in and secured to the inner ring 34, and outer ring 33 is secured to abutments 37 on the inner surface of forward section 22 of the spherical inner housing with screws 38. With this circular mounting frame 32 the motor 25 and connected fan blades 26 are automatically, centrally positioned and secured in the inner housing, in a simple but efficient manner.

Immediately forward or downstream of the fan blades 26 is a heating member 27 formed generally as a cylindrical cage having a plurality of axially-extending air passages formed as slots 39 between the strip heating elements 40. This heater is formed from a single metal sheet lanced to form parallel slots and expanded to produce a continuous strip of resistance material in a zig-zag pattern and then curved into a cylinder. Odd-numbered slots are cut at 39*a* through to the left edge, and even-numbered slots are cut through to the right edge to produce the continuous strip. There is a stiffening ring 41*a* at the rear end of the cylindrical heating member, and a forward stiffening ring 41*b* which is also secured in the discharge end 24 of the spherical housing, which thus automatically positions this member properly in relation to the fan blades. Immediately forward of ring 41*b* is a grill 41*c* which serves as a safety screen to prevent objects from touching the heater. Immediately downstream of the rotating fan blades 26, are six equally spaced stationary guide vanes 42 encircled by ring 42*a* fixedly mounted to the inner shell.

In the operation of this device, air flows generally as indicated by the curved arrows A in FIG. 3, after being drawn in through principal intake ducts 43 and additional ducts 44. The stationary guide vanes 42 tend to straighten the air flow from the fan, and convert turbulence to laminar flow. The air then flows inwardly through slots 39 of the heater 27, and then axially through the center of the heater and into the core 45 of the brush attachment 16, and then exits generally radially through apertures 47 adjacent the bristles 48. Apertures 49 provide an axial air flow along the sides of the bristles, and may be used in addition to or instead of apertures 47.

The air flow is set up by the power section 21 regardless of its orientation, either the straight-through position of FIG. 3, or the pivoted position of FIG. 4, or any intermediate position. The spherical inner housing 22 forces the air flow from the fan 26 to converge and flow inwardly through the heater 27, whereby the heat becomes concentrated in a central air column flowing axially through the center of the heater to the brush or other attachment. The different attachments in combination with the pivotable power section produce: (a) in the pistol grip configuration, of FIG. 4, a concentrated air flow through the barrel, (b) in the styler-dryer configuration of FIG. 1 a wide-area flow in only one direction, at a right angle to the central axis, and (c) in the straight-through configuration of FIGS. 2 and 3, a radial flow in all directions along the bristles or axially along all sides of the attachment. Regardless whether the power section is pivoted as in FIG. 4 or straight as in FIGS. 1–3, the heated air flow is initiated by the fan, then converged by the spherical shell and directed through the heater which concentrates the heat into a column, which then flows according to the particular configuration of the variation described above. It is also possible within the scope of this invention, to use fan blades of other configurations and other fan-motor arrangements, and other housing shapes, so long as the components are carried by the inner housing and the air is guided from the fan through the heater.

The principal intake air vents 43 in the outer shell or housing 13 are sufficient for the air needed by the fan, but are located to also cool the motor, and to do so in all pivoted positions of the power section within the housing. The remote auxilliary air vents 44 draw additional air the length of the handle, which tends to cool the electrical switch 50 and other components therein, and to flow past the motor 25, contributing slight additional cooling thereto.

Figure 7:
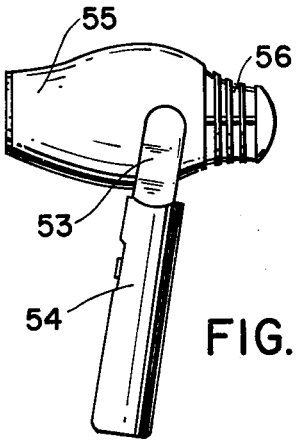
FIG. 7 is an elevation view of another embodiment.

A still further variation is shown in FIG. 7, where the outer shell is reduced to a yoke 53 from which a handle 54 extends, and the power section 55 is pivotable. Here the rear of the power section is closed but perforated with air vents 56, as contrasted with the power section in FIGS. 3 and 5 which is open, but encased in a perforated outer shell 13.

Typical electrical wiring is used, which may include a rectifier 51 when a d.c. motor is used and also various safety devices. The motor may be energized with or without the heater 27, and the level of power is variable to run the motor at high and low speeds, and to operate the heater at hot and warm conditions. The heater indicated as 27, comprising resistance strips or ribbon, may also be made of standard resistance wire and formed into many configurations, including non-cylindrical, so long as the air may easily flow over and between the heat elements.

The various brush, gun barrel and other attachments may have any convenient and economical attachment means, such as a simple frictional sleeve connection 52 as shown in FIG. 3, or a slide-and-turn bayonet connection, or a threaded connection. There are many other possible variations in structure of the remaining components within the broad inventive concept of a movable, self-contained power section. Also the design could allow the power section to move in other directions, such as laterally instead of, or in addition to, vertically, or to revolve. This is all feasible merely by having one partial sphere move or pivot within a mating partial sphere, with the power components mounted in one of said inner and outer spherical shells. While it is not necessary that the inner and outer housing be mating spheres, the spherical shape provides numerous advantages: The outer housing 13 has a large slotted discharge opening 53 extending 90° from the bottom to the front; the inner housing discharge port 24 extends through openings 53 in the various pivoted positions that the inner housing 21 and port 24 occupy, but opening 53 remains generally sealed against air leakage by portions of the inner housing which cover all portions of the opening 53 not occupied by port 24. Also it is convenient to use pivot means 28, 29 between adjacent walls of the inner and outer spheres. Finally the forward portion 22 of the inner housing 13 provides a natural converging shape for the air flow from the fan to the heater.

As regards manufacture of the preferred embodiments illustrated, molded plastic parts are used to a large extent, made according to standard molding processes. The above-described structures are presented only as preferred embodiments, with the understanding that there may be numerous variations in structure, while remaining within the scope of the invention.

I claim:

1. In a hair dryer including a fan driven by an electric motor, and electric heater downstream of the fan, and circuit means for selectively energizing said fan and heater, the improvement in combination therewith comprising: (a) an inner housing including a first central axis therethrough, (b) means mounting said motor, fan and heater within said inner housing, (c) an outer housing including a second central axis therethrough, and (d) connection means mounting said inner housing movably and at least partially within said outer housing for movement about a pivot axis, between a first position with said first and second axes generally aligned and a second position with said axes generally perpendicular, said inner housing comprising generally spherically curved walls which define a partial sphere shape having first inlet and discharge openings at opposite ends thereof, with said fan situated intermediate said openings, and said heater situated intermediate the fan and the discharge opening, whereby said motor, fan and heater are enclosed by said housings and air from the fan flows through the heater and out the discharge opening in the direction of said first central axis, said outer housing also comprising generally spherically curved walls which define a partial sphere shape and which at least partially encompass the inner housing, said pivot axis extending through middle parts of said spherical housings and generally normal to said central axes therethrough.

2. In a hair dryer including a fan driven by an electric motor, and electric heater downstream of the fan, and circuit means for selectively energizing said fan and heater, the improvement in combination therewith comprising: (a) an inner housing including a first central axis therethrough, (b) means mounting said motor, fan and heater within said inner housing, (c) an outer housing including a second central axis therethrough, and (d) connection means mounting said inner housing movably and at least partially within said outer housing for movement between a first position with said first and second axes generally aligned and a second position with said axes generally perpendicular, said inner housing formed by walls which define first inlet and discharge openings, with said fan situated intermediate said openings, and said heater situated intermediate the fan and the discharge opening, whereby said motor, fan and heater are enclosed by said housings, said heater is tubular comprising perforated cylindrical walls generally coaxial with said first central axis, and said inner housing walls guide said air flow from the fan inward through said heater walls, whereby said air is heated and then flows axially through said heater to said first discharge opening, said heater walls comprising a sheet of metal lanced and expanded to define a plurality of parallel strips connected at selected ends to define a continuous zig-zag pattern with a slotted aperture defined between each two adjacent strips, said strips oriented generally parallel to and spaced from said first central axis through said cylindrical heater, thus forming the walls of said heater, said strips comprising electrical resistance heating means and said slotted apertures defining passages through which said air flows from the fan to said first discharge opening of the inner housing.

3. In a hair dryer including a fan driven by an electric motor, and electric heater downstream of the fan, and circuit means for selectively energizing said fan and heater, the improvement in combination therewith comprising: (a) an inner housing comprising generally spherically curved walls which form an enclosure with a first central axis therethrough in the direction of air flow, a discharge duct extending outwardly from said wall in the direction of said first axis, a pivot axis perpendicular to said first axis, and an inlet opening spaced from said discharge duct, (b) means mounting said motor, fan and heater within said inner housing, with said fan situated intermedite said inlet opening and discharge duct, and said heater situated intermediate the fan and the discharge duct, whereby air from the fan flows through the heater and out said discharge duct, (c) an outer housing comprising generally spherically curved walls with a second central axis therethrough, a pivot axis perpendicular to said second central axis, a slot in said outer housing wall extending through an arc of about 90°, and an inlet opening, said inner housing dimensioned to fit within said outer housing, and (d) connection means mounting said inner housing movably and at least partially within said outer housing for movement between a first position with said first and second central axes respectively of said inner and outer housings generally coaxial and a second position with said first and second axes generally perpendicular, said discharge duct being dimensioned to extend through said slot and said walls of said housings cooperating to permit said inner and outer inlet openings to communicate while said inner housing is moved between said first and second positions.

4. A hair dryer according to claim 1 wherein said inner housing further comprises a tubular discharge duct extending from said discharge opening along said first central axis.

5. A hair dryer according to claim 1 wherein said outer housing comprises front and rear parts through which said second central axis extends, a discharge opening in said front part, and an elongated handle extending rearward from said rear part along said second axis, and said discharge duct of the inner housing extends downward through said discharge opening of the outer housing, while said inner housing is in both of said first and second positions.

6. Apparatus according to claim 1 wherein said heater is tubular, comprising perforated cylindrical walls generally coaxial with said first central axis, and said inner housing walls guide said air flow from the fan inward through said heater walls, whereby said air is heated and then flows axially through said heater to said first discharge opening.

7. Apparatus according to claim 3 wherein said heater is tubular, comprising perforated cylindrical walls generally coaxial with said first central axis, and said generally spherical walls of said inner housing converge toward said first discharge opening and thereby guide said air flow from the fan to said heater.

8. Apparatus according to claim 1 further comprising brush means formed as a tubular body part having an end removably secured to said inner housing and communicating with said first discharge opening for receiving the heated air flow therefrom, having a central axis generally coaxial with said first central axis, and a plurality of bristles extending generally perpendicular to said central axis and distributed about the circumference, extending generally radially outward from said body part.

9. Apparatus according to claim 1 wherein said inner housing further comprises stationary guide vanes downstream of said fan and extending generally parallel with said first central axis, for guiding and reducing turbulence of said air flow from said fan to said heater.

10. Apparatus according to claim 1 wherein said motor has a rotary drive shaft generally coaxial with said first central axis through said inner housing, said fan comprises a bladed rotor mounted coaxially on said motor shaft, and said heater is tubular and also is mounted coaxially with said rotor.

11. Apparatus according to claim 1 wherein said means mounting said motor is a frame comprising an inner ring encircling and securely engaging the motor, an outer ring generally concentric and radially outward of said inner ring, and secured to walls of said inner housing, and a plurality of circumferentially spaced spokes extending generally radially between and engaging said inner and outer rings.

12. Apparatus according to claim 6 wherein said heater has a downstream end sealingly secured to said inner housing adjacent and communicating with said first discharge opening.

13. A hair dryer according to claim 3, wherein said heater is located axially downstream of the fan.

14. Apparatus according to claim 1 further comprising an elongated handle extending from said outer housing, the handle having a central longitudinal axis generally coincident with said second central axis through said outer housing.

* * * * *